United States Patent [19]

White

[11] Patent Number: 4,831,682

[45] Date of Patent: May 23, 1989

[54] PROTECTIVE COVER FOR FLOOR TREATING MACHINE

[76] Inventor: Charles R. White, 8064 Virgo St., Jacksonville, Fla. 32216

[21] Appl. No.: 226,895

[22] Filed: Aug. 1, 1988

[51] Int. Cl.[4] ..... A47L 9/00
[52] U.S. Cl. ..... 15/325; 15/257 A
[58] Field of Search ..... 15/325, 257 A, 410

[56] References Cited

U.S. PATENT DOCUMENTS 2,241,862 5/1941 Langille ..... 15/325
4,437,204 3/1984 Gühne ..... 15/325

FOREIGN PATENT DOCUMENTS 3403800 8/1985 German Democratic Rep. ... 15/325
2154128 9/1985 United Kingdom ..... 15/325

*Primary Examiner*—Chris K. Moore
*Attorney, Agent, or Firm*—Arthur G. Yeager

[57] ABSTRACT

A protective cover for a vacuum cleaner or other floor treating machine to prevent marring furniture, base boards, and any other object or fixture likely to come in contact with the machine; the cover including a portion over the lateral and/or upper surface of the head, and a portion over the handle and a portion of the cannister to cover portions being releasably attachable to the machine and being made of a soft fabric, including felt-like materials, single layer of multi-layer fabrics, such as velour and quilted materials, respectively.

14 Claims, 5 Drawing Sheets

PROTECTIVE COVER FOR FLOOR TREATING MACHINE

BACKGROUND OF THE INVENTION

Floor treating machines such as vacuum sweepers, carpet cleaning machines, waxing machines, etc. are frequently used around and under furniture, and are nearly always used very close to base boards and door frames and doors with the result that the machine causes surface damage to the furniture and the base boards. In the past such machines have been fitted with a rubber bumper strip around the broadest portions of the head. See, for example, U.S. Pat. Nos. 1,695,246; 2,241,862; 2,247,946; 2,330,684; 2,622,263; 2,262,173 and 3,270,365. These patents show a bank or strip of a rubbery material around the head of the cleaner which serves the purpose of protecting the machine from scratches and protecting the furniture and base boards from excessive dents and chips and gouges. Unfortunately, such rubber bumpers do mar soft wood or a polished wood surface by destroying the sheen, and leave marks on most other surfaces as well. Furthermore, there are other parts of the vacuum cleaner which may damage a polished surface. The tops of the heads and the handles of the cleaners also may contact furniture, and therefore should be protected so as not to cause damage to the door frames and doors or tables and the like.

It is an object of this invention to provide covers for vacuum cleaners or similar floor treating machines that will be soft and relatively slippery so as not to mar surfaces or finishes on objects it may contact. It is another object of this invention to provide such cover portions that can readily be attached to the machine or detached from the machine and readily replaced when worn or damaged. Still other objects will become apparent from the more detailed description which follows.

BRIEF SUMMARY OF THE INVENTION

This invention relates to a protective cover for various floor treating machines having a treating head adapted to be moved about the floor and a handle extending upward from the head for the operator to direct the machine, said cover comprising a head cover portion releasably attachable to the head around the lateral surfaces of and when appropriate around selected upper surfaces of the head, and a handle cover around all of the handle except the distal portion where the hand or hands of the operator are placed, the cover being a soft material that does not mar finished surfaces and easily slips on most such surfaces, and fitting the head and handle snugly by reason of releasable fastening means which connect the cover portions to the machine.

In preferred embodiments the cover may include elastic bands to make it fit more snugly to the contours of the machine; and may also employ pads of Velcro type fasteners, formed from fluff and hook materials, for rapid attachment. In other embodiments the cover portions may be attached to the machine by way of pads of double-sided pressure-sensitive tape. On some head portions selected edges include elastic to cause the head portions to snugly fit about the head of a machine. Elastic bands are employed on some head portions and on some handle portions of the cover.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THIS INVENTION

This invention and its many features are best understood by reference to the attached drawings wherein several types of vacuum cleaners are illustrated along with the covers of this invention attached to those cleaners.

Figure 19:
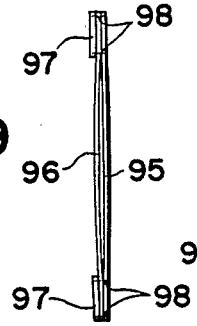
FIG. 19 is an end elevational view of the cover of FIG. 18.
Figure 18:
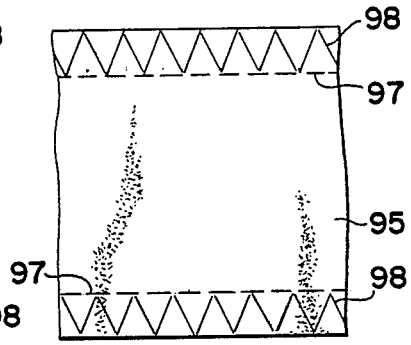
FIG. 18 is a front elevational view of a preferred cover of this invention.
Figure 20:
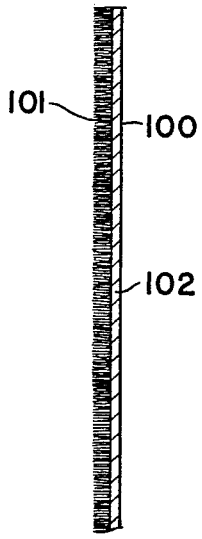
FIG. 20 is an end elevational view of another cover material of this invention.
Figure 21:
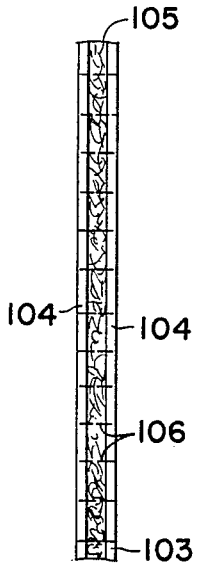
FIG. 21 is an end elevational view of a further cover material of this invention.
Figure 22:
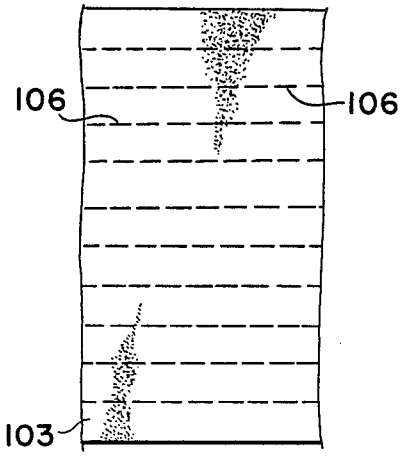
FIG. 22 is a front elevational view of the cover material of FIG. 21.

Generally, the cover is made of a composite multilayered fabric which is cut and sewn to fit portions of the machine that are intended to be covered. In FIGS. 18 and 19 a preferred cover material is illustrated and described in general for a full understanding of the invention. The outside layer 95 of the cover is a felt or similar soft, non-tacky, easily slidable material. Such a material must not scratch a soft or polished wood surface and should be somewhat slippery when in contact with any surface. The fabric or felt may be of natural or synthetic materials. Inside layer 96 is a woven fabric of cotton, nylon, polyester, or the like. This material furnishes a nonstretchable base to which felt layer 95 may be sewn by stitches 98 of any design suitable to hold together layers 95 and 96. Frequently, but not always, an elastic band 97 is sewn along the edges of the material to provide a gathering which helps to fit the cover snugly around portions of the machines. It is to be noted that when certain other types of fabrics are used to construct covers, only one layer may be necessary, as when using a soft, thick fabric such as velour-like fabrics 100, shown in FIG. 20, with fluff 101 on the outside and an integral backing 102. With other types of materials, such as quilted materials, there may be three or more layers along with appropriate fastenings between the layers and other finishing. Typically, such quilted fabrics 103 include two outer woven layers 104 with a batting or padding layer 105 therebetween affixed together by stitching 106. It is to be understood that when quilted fabric is used, for example, as the cover 89 or 91, the stitching lines 106 would be horizontal and when used for cover 90 the stitching lines 106 would be vertical.

In FIGS. 1–17 there are several types of vacuum cleaners illustrated, and the covers according to preferred embodiments of this invention are shown on each type of machine.

Figure 1:
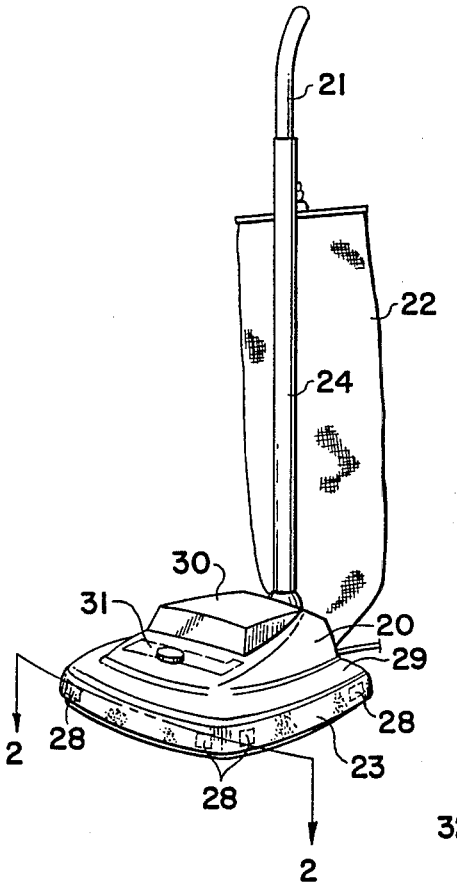
FIG. 1 is a perspective view of one type of vacuum cleaner machine with the cover in accord with a first embodiment of this invention attached to the handle and to the head.
Figure 2:
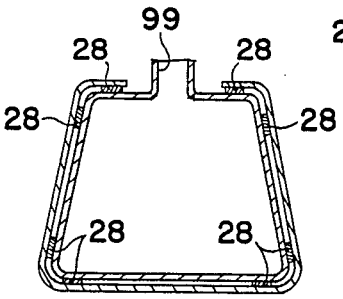
FIG. 2 is a cross sectional view taken at 2—2 of FIG. 1.
Figure 3:
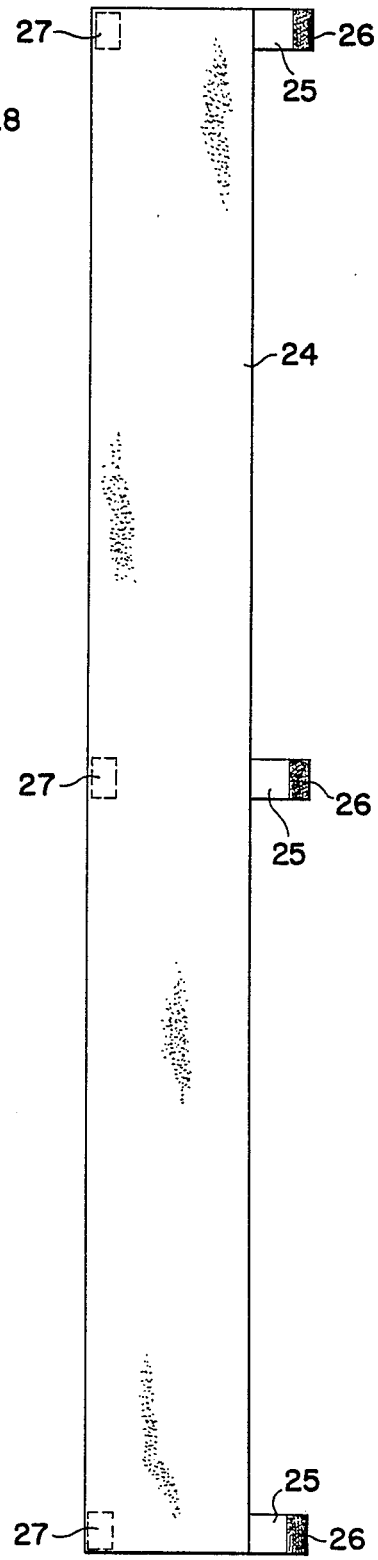
FIG. 3 is a top plan view of the handle cover detached from the machine of FIG. 1.

In FIGS. 1–3 there is shown the well-known upright vacuum cleaner having a head 20, a handle 21, and a bag 22. Generally, each commercial make of machine has these same three components with the principal differences being in the head, and, less frequently, in the handle. On the other hand, some vacuum cleaners have two separate components linked together by a flexible hose (see FIGS. 15 and 16), the head and handle being in one component and the motor and fan being on a carrier pulled along by the operator. In each of these designs it is important in this invention to provide a protective cover in the form of a strip or a substantially overall cover on those surfaces that might and often do come into contact with surfaces of wood or the like. Each machine generally requires a separate and distinctive cover design as will be described below. However, in each design the surfaces that would most likely contact chair and table legs and base boards are covered while other surfaces that have little likelihood of touching chair legs, table legs, and base boards are not covered, and, of course, controls for the machines are usually not covered.

The vacuum cleaner illustrated in FIGS. 1–7 is illustrative of basic upright models of various brand names. It has a head 20 mounted on suitable wheels that house the motor and the fan necessary to produce the suction through a lateral slot in the forward portion of the head facing the floor. A dust collection bag 22 and a handle 21 are attached to head 20. Elongated handle 21 is pivoted so as to be adjustable to any angle to generally accommodate the height of the operator and to permit pushing head 20 under tables, chairs, high beds, and the like. Bag 22 is attached to the outlet of the fan through a pipe nipple 99. A head cover 23 is wrapped around the outermost vertical surfaces over the rubber bumper about head 20 since these surfaces would be ones that would contact a base board or the legs of chairs, tables, and the like. A handle cover 24 is wrapped around the tubular handle 21 from adjacent its pivotal attachment to head 20 to the distal end of handle 22 where a portion is left uncovered to be gripped by the operator in pushing, pulling, and guiding head 20 to the areas of the floor or carpet which must be cleaned. Head cover 23 is an elongated strip which is attached to head 20 by spaced pads of double-sided pressure-sensitive adhesive tape or Velcro type fluff and hood fasteners having adhesive bases. One side of pad 28 is stuck to the outside surface of head 20 (which may be metal or plastic or be part of the hard rubber bumper) and the other side is stuck to fabric cover 23, which as described above, preferably has a smooth felt-like outer surface and a woven cloth inner surface.

For the handle cover 24, as shown opened in FIG. 3, it includes an elongated strip of fabric which is wide enough to wrap around at least three quarters of the outer cylindrical surface of the handle 21 and long enough to cover all the straight areas as mentioned above. The preferred method of attachment of cover 24 to handle 21 is by a plurality of straps 25 which can be wrapped around the back side of the handle 21 and fastened snugly in place. A preferred type of fastener for the handle cover is a Velcro fastener combining a pad of fabric hooks 26 and a pad of fabric loops 27. Other fasteners such as snaps or hooks are also usable. Furthermore, straps 25 preferably, are made stretchable by using an elastic tape or band.

Figure 5:
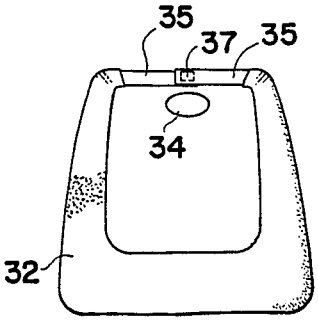
FIG. 5 is a top plan view of the head and its cover of the machine of FIG. 4.
Figure 4:
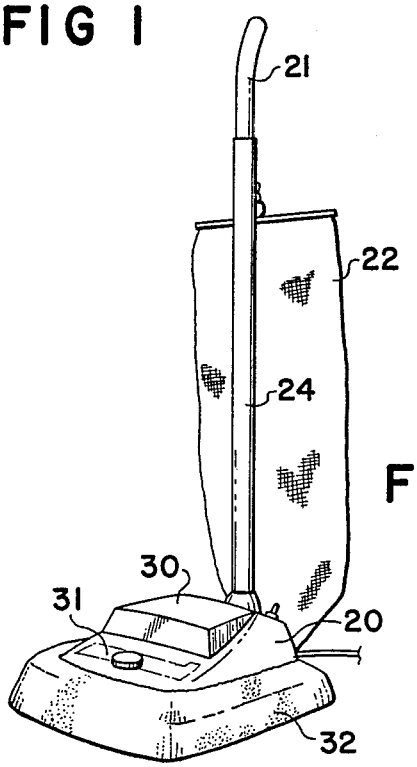
FIG. 4. is a perspective view of a second embodiment of the invention as applied to the machine of FIG. 1.
Figure 6:
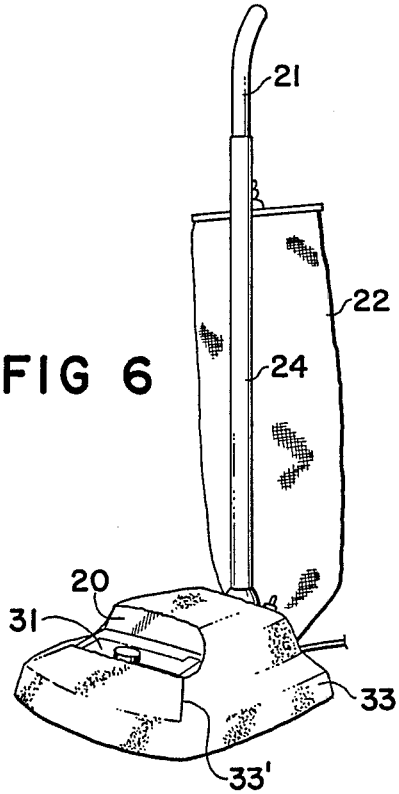
FIG. 6 is a perspective view of a third embodiment of the invention as applied to the machine of FIG. 1.
Figure 7:
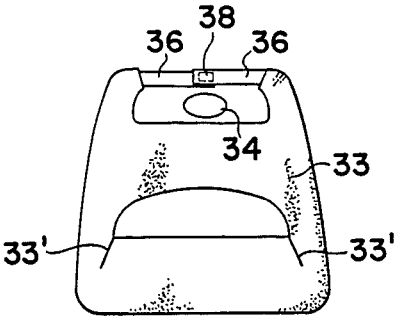
FIG. 7 is a top plan view of the head and its cover of the machine of FIG. 6.

In FIGS. 4–7 the same vacuum cleaner as shown in FIG. 1 is subjected to other cover designs in accord with this invention. Head 20, handle 21, and bag 22 are identical to the corresponding components in FIG. 1. Handle cover 24 is identical in both FIGS. 4 and 6 to the handle cover 24 of FIGS. 1 and 3. The differences lie in the covers for heads 20. In FIGS. 4 and 5 the head cover 32 extends upwards and inwards over the first ledge 29 of head 20. In FIGS. 6 and 7 cover 33 extends over all of the upper surfaces, including surface 30, of head 20 except the portion 31 where there is a light and a control knob. It is apparent that these designs provide greater protection against scuffing furniture when the head 20 is pushed under the furniture. It is, of course, for the operator to choose which design is most suitable for the operator's needs and, of course, the cover 33 would be more expensive. In FIGS. 5 and 7 head covers 32 and 33 are seen to be fashioned to fit the front and upper contours of head 20 by sewing the necessary portions together. Covers 32 and 33 are fastened in the back of head 20 with straps 35 and 36 and overlapped Velcro fasteners 37 and 38. It is necessary to employ straps 35 and 36 so as to fit around pipe nipple 34 to which bag 24 is attached. Tapes 35 and 36 may be made of elastic straps or bands to provide a means for holding covers 32 and 33 snugly around head 20, around the normal hard rubber bumpers of such heads. Cover 33 includes spaced miters 33' to better conform the cover to the upper contour of head 20.

Figure 9:
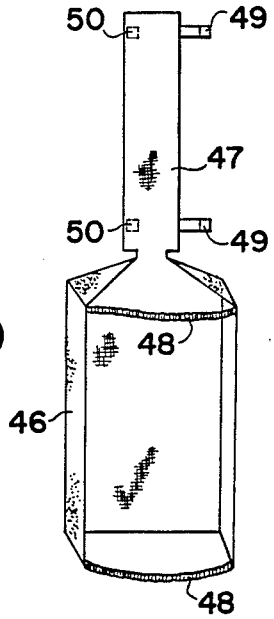
FIG. 9 is a rear perspective view of the handle cover portion of FIG. 8.
Figure 8:
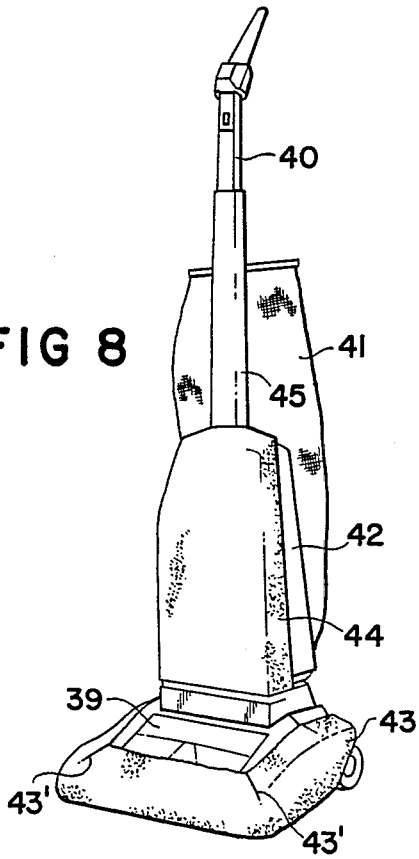
FIG. 8 is a perspective view of a fourth embodiment of the covers of this invention attached to another machine.
Figure 10:
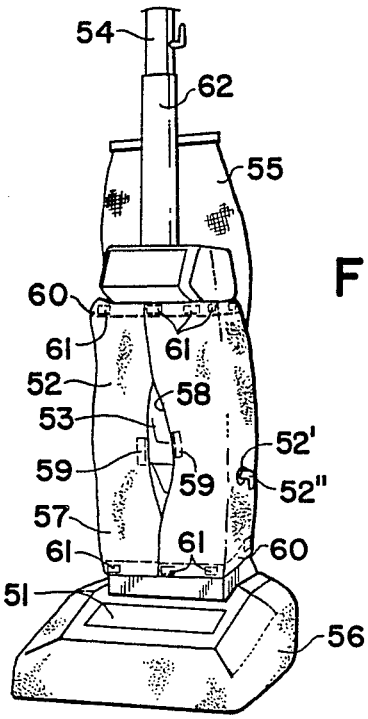
FIG. 10 is a perspective view of a fifth embodiment of the covers of this invention attached to the machine of FIG. 9 but with an added feature.

In FIGS. 8–10 there is illustrated a Hoover Concept type vacuum cleaner which in addition to the head, handle, and bag has a vertical housing or cannister 42 or 52 connecting the handle to the head. In FIG. 8, head 39, handle 40 and bag 41 are similar to those components of the cleaners in FIGS. 1, 4 and 6. In addition, however, there is a cannister 42 built around the lower part of handle 40 to house a portion of the cleaning mechanism. Head cover 43 is fitted by miters 43' around the outer surfaces of the head 39, preferably using elastic bands sewed into the edges of the cover fabric so as to draw the cover 43 tightly around the central portion of head 39. Handle cover 45 and cannister cover 44 are joined into a single unit as shown in FIGS. 8 and 9. Handle cover portion 47 is substantially identical in principle to cover 24 in FIG. 3 in being an elongated strip with spaced straps 49 terminating in hook or fluff Velcro pads connecting to correspondingly opposite Velcro pads 50. Cannister cover portion 46 covers the front and at least a portion of the two sides of cannister 42. Two spaced elastic straps or bands 48 are included to hold the sides of cover portion 46 snugly against cannister 42.

The vacuum cleaner of FIG. 10 is similar to that of FIG. 8 except that this one includes a small hand held cleaner 53 (sometimes referred to as a "Dustbuster") on the front of cannister 52. Accordingly, cover 57 is provided with an elongated front opening 58, held together with releasable fasteners 59, such as Velcro pads. Furthermore, because of opening 58 it is preferred to employ elastic edges 60 on cover 57 and elastic bands, identical to bands 48 in FIG. 9, to fasten cover 57 to cannister 52. A plurality of pads 61 of double-sided adhesive tape at both the top and bottom edges might be employed to more firmly affix the cover 57 to the machine. Handle 54 is covered by handle cover 62 constructed similarly to that of FIG. 9, although it is preferred not to connect it to cannister cover 57. Bag 55 is connected to handle 54 and to head 51 in the usual manner. A side opening 52' is provided through cover 57 to accommodate electrical cord hook 52''. The electrical cord of the machine in FIG. 8 is retractable into cannister 42 from its left side as viewed from the front and cover 44 does not interfere with its extension or retraction.

Figure 11:
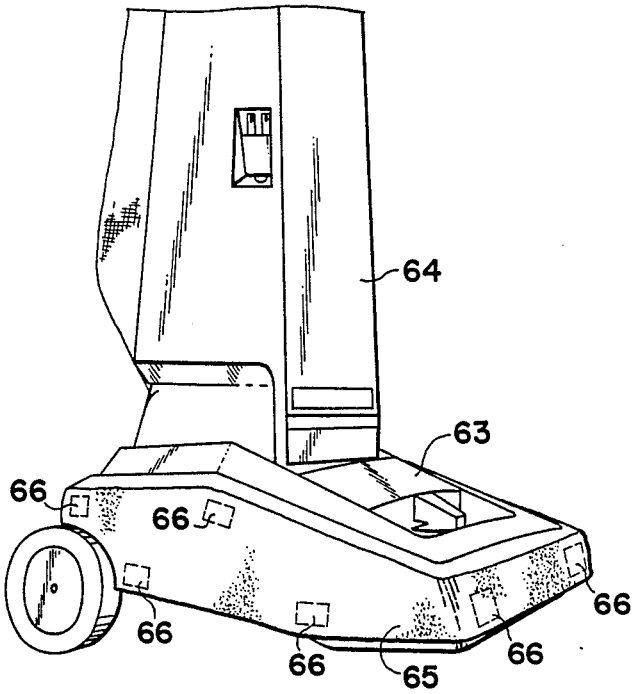
FIG. 11 is a perspective view of a sixth embodiment of the head cover of this invention showing another machine.
Figure 12:
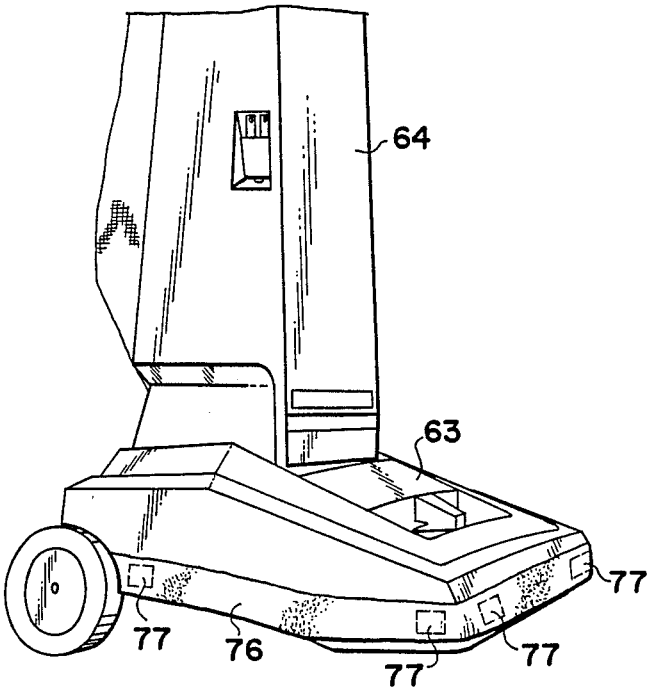
FIG. 12 is a perspective view of the machine of FIG. 11 with an alternate type of head cover attached.
Figure 14:
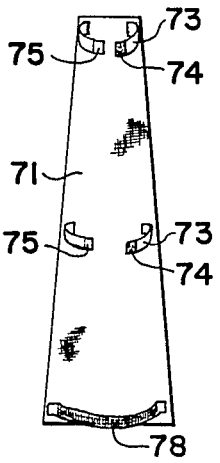
FIG. 14 is a plan view of the handle cover for the machine of FIG. 13.

In FIGS. 11–12 a similar Hoover Concept type vacuum is illustrated in which the cleaner head 63 has a wide strip cover 65 along the side in FIG. 11 and by a narrow strip cover 76 in FIG. 12 over the hard rubber bumper. Cannister 64 is shown without a cover. Head cover 65 is attached to head 63 by a plurality of spaced pads 66 of double-sided adhesive tape or Velcro pads. Cover 76 is similarly attached to head 63 by a plurality of spaced pads 77. It is necessary to at least provide the protection afforded by cover 76 but cover 65 is preferred over cover 76. Likewise, covers 43 or 56 are preferred over either covers 76 or 65.

Figure 13:
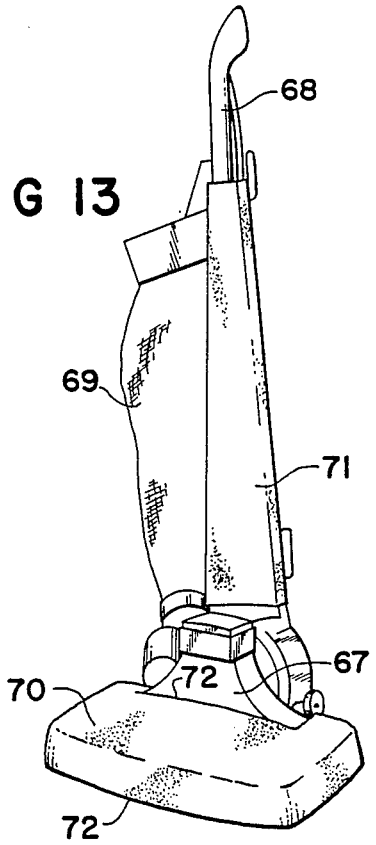
FIG. 13 is a perspective view of a seventh embodiment of the covers of this invention showing another machine.

FIG. 13 illustrates a Kirby type vacuum cleaner having a head 67, a handle 68 and a bag 69. Head cover 70 is made to fit over the flared portions of head 67 and includes elastic bands along the edges 72 to assist in conforming and holding cover 70 in place. Handle 68 includes a central section which is generally in the shape of an elongated trapezoid. The cover 71 for this portion of the handle 68 includes an elastic band 78 along the bottom to hold cover 71 in the form of a single flat piece of elastic against that portion of handle 68. At the top portion and in the middle are two pairs of straps 73 sewn to cover 71 with the other ends containing a Velcro fastener pad 74 or 75 of fabric hooks or fabric loops.

Figure 15:
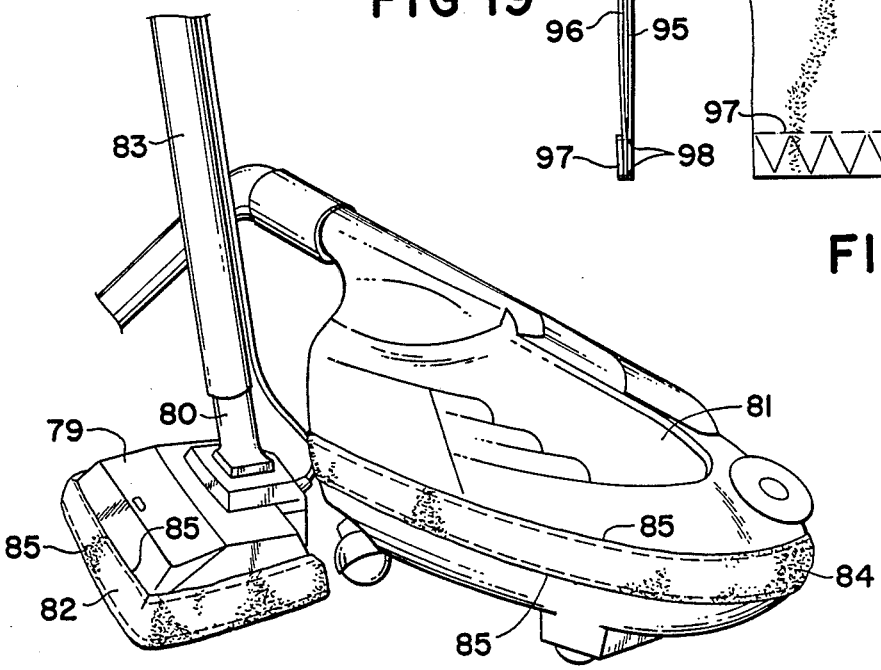
FIG. 15 is a perspective view of an eighth embodiment of the covers of this invention attached to another machine.
Figure 16:
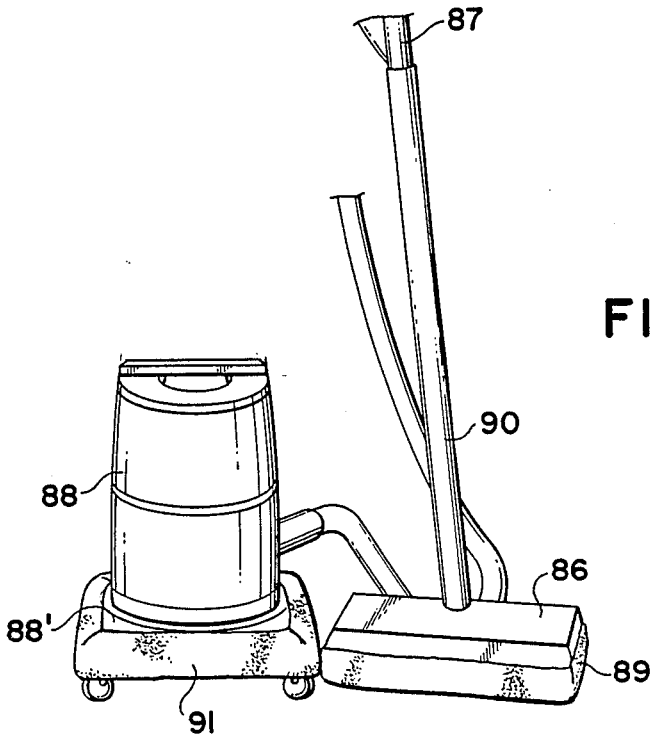
FIG. 16 is a perspective view of a ninth embodiment of the covers of this invention attached to another machine.

FIGS. 15 and 16 show other types of vacuum cleaners where the handle and head are separated from the motor and fan. A Tri-Star type machine is shown in FIG. 15 with a head 79 and a handle 80. Head 79, about its hard rubber bumper, is covered with a strip cover 82 having elastic band edges 85 and may be fastened at the rear by cooperating pads of an adhesive backed Velcro fastener, or may be attached to head 79 with spaced pads of double-sided adhesive tape. A band cover 84 is also fastened to suction motor and fan carrier 81, preferably including elastic band edges 85 to make cover 82 snug thereabout and inhibit displacement vertically from its proper location. Handle 80 is covered with handle cover 83 generally as shown in FIG. 3.

Figure 17:
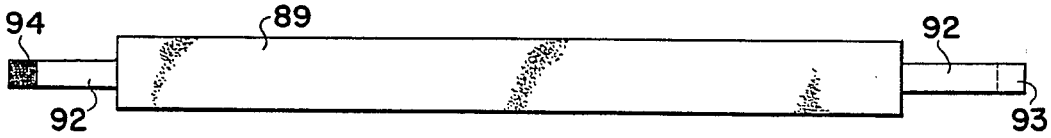
FIG. 17 is a plan view of the head cover on the machine of FIG. 16.

In FIG. 16 is a Rainbow type vacuum cleaner and the same general arrangement as in FIG. 15 is provided. Head 86 and handle 87 are covered with head cover strip 89 and handle cover 90. Motor and fan housing 88 has a flanged base carrier 88' which is covered with a strip cover 91. One manner of fabricating cover 89 is shown in FIG. 17 where the main portion of the cover 89 is the fabric combination of FIGS. 18 and 19 and at each end is an elastic band strap 92 with a Velcro pad 93 and 94 (93 being hooks or loops and 94 being the opposite) at the respective ends. Such a cover can be stretched around the machine part to make a snug cover.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A protective cover for a floor treating machine having a treating head adapted to be moved about a floor and a handle extending upward from its head for an operator to move about and direct, said cover comprising a head cover portion releasably attachable to a head around its lateral surfaces including a bumper portion of a head which normally engages wooden baseboards and door frames and furniture and other markable surfaces, and a handle cover portion around a handle of a machine and leaving exposed a distal portion thereof where a hand of an operator is placed, said cover being formed of a soft material that does not mar finished wood work or other markable surfaces and easily slips on such surfaces when engaged by inadvertent contact with such surfaces, releasable fastening means on said head cover portion and said handle cover portion for snugly attaching said portions respectively to a head and a handle of a machine.

2. The cover of claim 1 wherein said fastening means includes elastic fasteners.

3. The cover of claim 1 wherein said fastening means include hook and fluff fasteners.

4. The cover of claim 1 wherein said fastening means includes elastic means along selected edges of said head cover portion which gather said head cover portion when detached and which permit expansion thereof to snugly fit about a head of a machine.

5. The cover of claim 1 further comprising a cannister cover portion, and means to releasably connect said cannister cover portion to a cannister of a machine.

6. The cover of claim 5 wherein said cannister cover portion includes a band of said soft material having opposed side edges, said means to releasably connect including elastic means along each said side edge to permit expansion thereof to position said cannister cover portion about a bumper portion of cannister and contraction thereof thereabout to snugly fit said cannister cover portion to a cannister about its bumper portion.

7. The cover of claim 1 wherein said fastening means includes a plurality of snap fasteners spaced along said handle cover portion.

8. The cover of claim 1 wherein said fastening means includes a plurality of elastic bands.

9. The cover of claim 1 wherein said releasable fastening means includes spaced pads of hook material attached to a head of a machine and corresponding spaced pads of fluff material attached to an inside surface of said head cover portion.

10. The cover of claim 1 wherein said releasable fastening means includes spaced pads of double-sided pressure-sensitive tape attaching said cover to a head of a machine.

11. The cover of claim 1 wherein said handle cover portion includes an enlarged portion adjacent its lower end, said enlarged portion having a generally vertical split therein, and means to releasably fasten said split together and to permit opening thereof for removal of a part of a machine beneath said split without removal of said handle cover portion.

12. The cover of claim 1 wherein said material is felt forming an outer surface and wherein said cover includes a woven backing secured to said felt and forming an inner surface adapted to be positioned adjacent a floor treating machine.

13. The cover of claim 1 wherein said material is velour having a fluff outer surface for said cover and an integral backing inner surface adapted to be positioned adjacent a floor treating machine.

14. The cover of claim 1 wherein said material is a quilted fabric having a pair of spaced outer woven layers and a batting layer sandwiched therebetween and being affixed together by stitching lines through said layers.

* * * * *